US010000905B2

(12) United States Patent
Leverty et al.

(10) Patent No.: US 10,000,905 B2
(45) Date of Patent: Jun. 19, 2018

(54) CUTTERHEAD DEBRIS GUARD

(71) Applicant: Liquid Waste Technology, LLC, New Richmond, WI (US)

(72) Inventors: Richard Leverty, Somerset, WI (US); John Gillis, Deer Park, WI (US); Brian John Lindahl, Somerset, WI (US)

(73) Assignee: Liquid Waste Technology, LLC, New Richmond, WI (US)

( * ) Notice: Subject to any disclaimer, the term of this patent is extended or adjusted under 35 U.S.C. 154(b) by 0 days. days.

(21) Appl. No.: 15/238,540

(22) Filed: Aug. 16, 2016

(65) Prior Publication Data

US 2018/0051440 A1 Feb. 22, 2018

(51) Int. Cl.

| | |
|---|---|
| ***E02F 3/94*** | (2006.01) |
| ***E02F 3/88*** | (2006.01) |
| ***E02F 5/28*** | (2006.01) |
| ***E02F 3/92*** | (2006.01) |

(52) U.S. Cl.

CPC ..... *E02F 3/94* (2013.01); *E02F 3/885* (2013.01); *E02F 3/8841* (2013.01); *E02F 3/9225* (2013.01); *E02F 5/282* (2013.01)

(58) Field of Classification Search

CPC ..... E02F 3/8841; E02F 3/94; E02F 3/9555; E02F 5/282; E02B 3/023; E02B 3/026

See application file for complete search history.

(56) References Cited

U.S. PATENT DOCUMENTS 3,521,387 A * 7/1970 Degelman ..... E02F 3/88 37/189
3,971,148 A * 7/1976 Deal ..... E02F 3/9237 198/497
4,365,427 A * 12/1982 Chapman, Jr. ..... E02F 3/9231 241/84

* cited by examiner

*Primary Examiner* — Tara Leigh Mayo-Pinnock
(74) *Attorney, Agent, or Firm* — Hovey Williams LLP

(57) ABSTRACT

A cutterhead for dredging water-bed material from a body of water. The cutterhead comprises a shroud presenting a front margin for receiving water-bed material into an interior space of the shroud. The shroud additionally includes a port from which water-bed material can be removed from the interior space of the shroud. The cutterhead additionally comprises a rotatable cutterbar at least partially received within the interior space of the shroud. The cutterhead further comprises a debris guard positioned between the cutterbar and the port. The debris guard is operable to filter the water-bed material removed from the shroud through the port. At least a portion of the debris guard that faces the cutterbar includes a concave shape.

18 Claims, 8 Drawing Sheets

CUTTERHEAD DEBRIS GUARD

FIELD OF THE INVENTION

Embodiments of the present invention broadly concern a debris guard for a cutterhead. More particularly, embodiments are directed to a debris guard for a cutterhead, with the cutterhead configured for use on a dredging-type watercraft, which dredges material from a water-bed, such as from a riverbed, a seabed, or the like.

BACKGROUND

Dredges (i.e., dredging-type watercraft) are commonly used to remove sediments, vegetation, and/or debris, from the bottom areas of various types of bodies of water. Such bottom areas are herein described as a "water-beds." For example, dredges may remove silt from a riverbed, sand from a seabed, or other materials from other types of water-beds. Dredges typically comprise a hull which floats on top of the water. A boom with a cutterhead can be pivotally attached to the hull. As such, when the cutterhead is in a lowered position, i.e., with the cutterhead positioned adjacent to the water-bed, the cutterhead can be operated in combination with a pump to stir up and remove a slurry of water-bed material from the body of water.

Traditional dredges have implemented cutterheads that include a rotatable cutterbar within a shroud. With the cutterhead positioned adjacent to the water-bed, the rotatable cutterbar grinds into the water-bed and churns water-bed material, such that the water-bed material can be fluidized with the surrounding liquid to form a slurry. In addition, traditional dredges have also included pumps fluidly connected to the cutterhead, such as via a back side of the shroud, such that the dredge is capable of pumping the slurry away from the dredge to a barge or to an adjacent shoreline.

However, during dredging operations, certain types of debris can be encountered, which can clog or damage the dredge's cutterhead and/or pump, thereby interrupting or preventing dredging operations. For example, large, hard objects, such as rocks, trash, or other debris material, can clog or damage the cutterhead and/or pump. Some previously-used cutterheads implemented grate-like guards positioned upstream of the pump, with such guards being used to prevent such problematic debris from being introduced to the pump. However, such previously-used guards were generally rectangular in shape such that while the guards were effective at preventing problematic debris from being introduced the pump, the shape of the guards allowed the debris to remain within the shroud. With such debris remaining within the shroud, the cutterbar can be damaged by the debris. Furthermore, such debris can negatively affect the actuation of the cutterbar, which further inhibits dredging operations. In such instances, dredging operations are required to be halted, such that the debris can be manually removed from the cutterhead. As such, there is a need for an improved cutterhead that, in addition to preventing unwanted debris from entering the pump, will function to automatically remove any unwanted debris from the cutterhead.

SUMMARY

The present invention solves the above-described problems and provides a distinct advance in the art of dredging.

One embodiment of the present invention broadly includes a cutterhead for dredging water-bed material from a body of water. The cutterhead comprises a shroud presenting a front margin for receiving water-bed material into an interior space of the shroud. The shroud additionally includes a port from which water-bed material can be removed from the interior space of the shroud. The cutterhead additionally comprises a rotatable cutterbar at least partially received within the interior space of the shroud. The cutterhead further comprises a debris guard positioned between the cutterbar and the port. The debris guard is operable to filter the water-bed material removed from the shroud through the port. At least a portion of the debris guard that faces the cutterbar includes a concave shape.

Another embodiment of the present invention includes a dredge-type watercraft comprising a hull, a boom having first and second ends, with the first end being pivotably secured to the hull, and a cutterhead secured to the second end of the boom. The cutterhead includes a rotatable cutterbar for fluidizing water-bed material. The cutterhead additionally includes a shroud for receiving the fluidized material, wherein the shroud includes a port through which the fluidized material is removed from the shroud. The cutterhead further includes a debris guard positioned over the port, with the debris guard being configured to filter debris from the fluidized material passing through the port. At least a portion of the debris guard is formed to include a concave shape, such that the cutterbar is configured to remove filtered debris from the debris guard.

A further embodiment of the present invention includes a method for dredging material from a water-bed. The method comprises an initial step of lowering a boom from a watercraft. The boom includes a cutterhead attached thereto with a cutterbar for fluidizing material from the water-bed. The cutterhead includes a port through which the fluidized material is removed from the cutterhead, and a debris guard positioned over the port for filtering debris from the fluidized material. During the lowering step, the boom is lowered such that the cutterhead is positioned adjacent to the water-bed. The method includes an additional step of fluidizing material from the water-bed. The method includes an additional step of drawing fluidized material into the cutterhead. The method includes an additional step of filtering, via the debris guard, debris from the fluidized material. The method includes a further step of removing the filtered debris, via the cutterbar, from the debris guard.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein.

Figure 1:
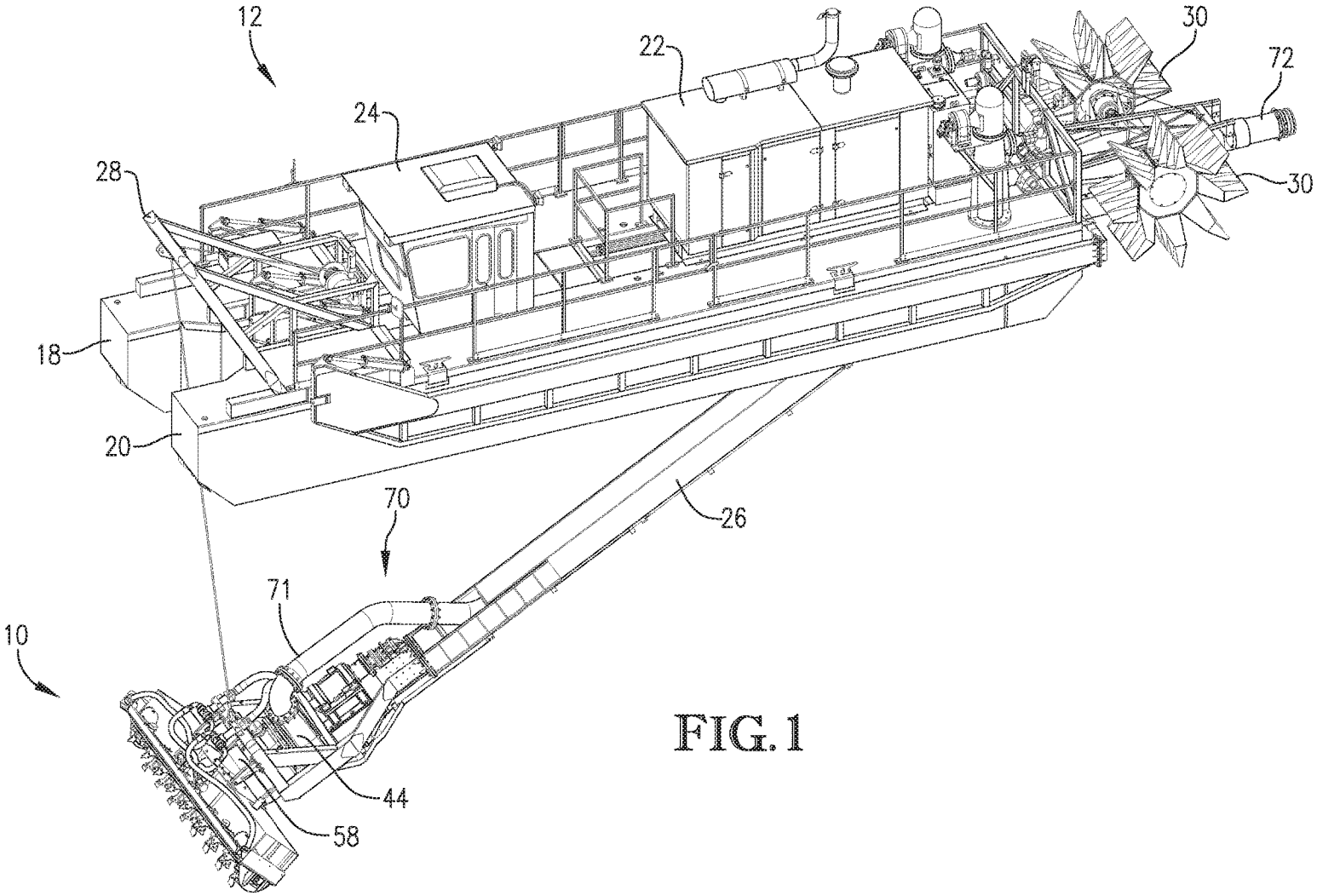
FIG. 1 is a front, left perspective view of a dredging-type watercraft with a cutterhead according to embodiments of the present invention.
Figure 2:
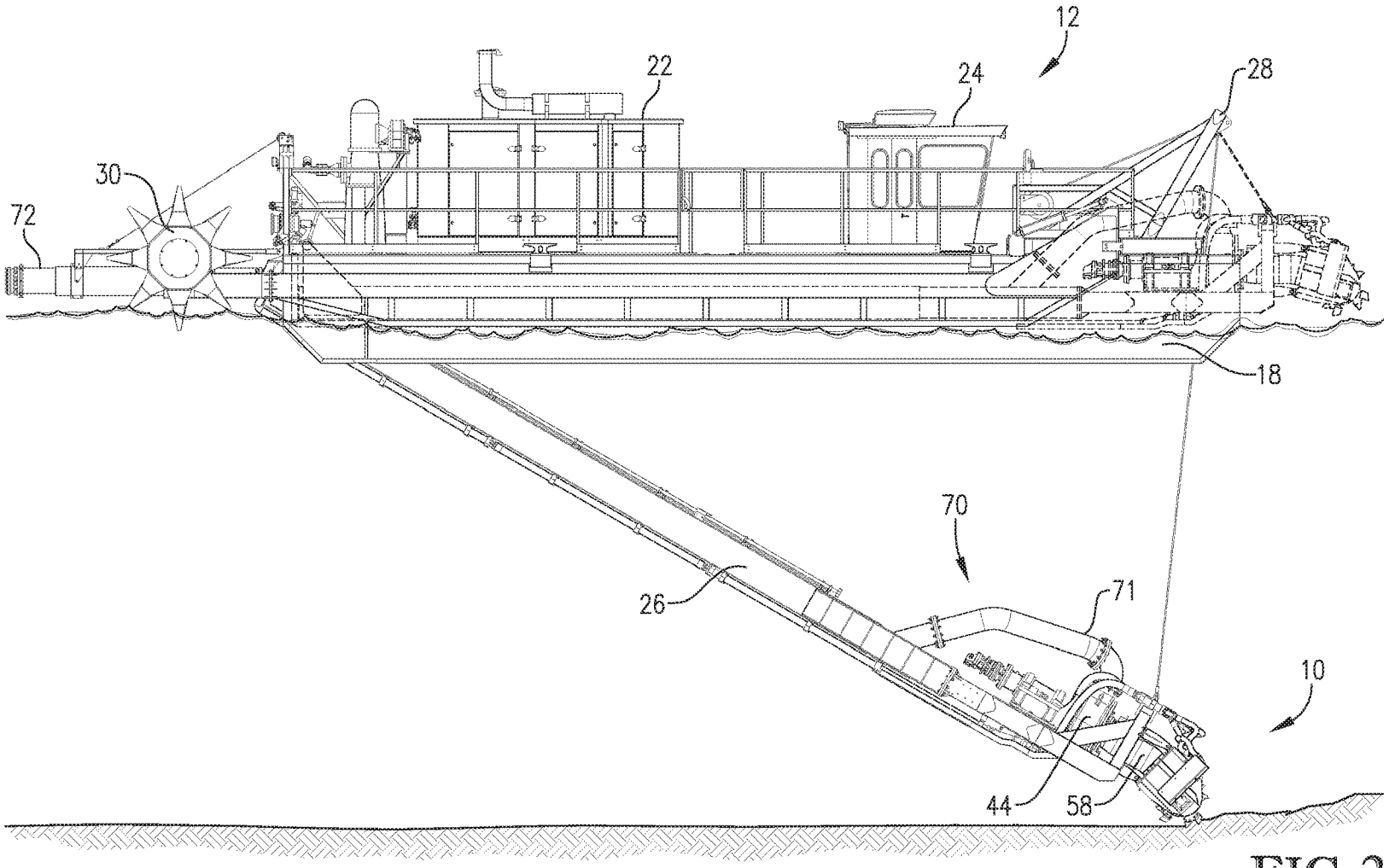
FIG. 2 is a right elevation view of the watercraft from FIG. 1, with the watercraft on surface of a body of water and the cutterhead positioned adjacent to a water-bed of the body of water.
Figure 3:
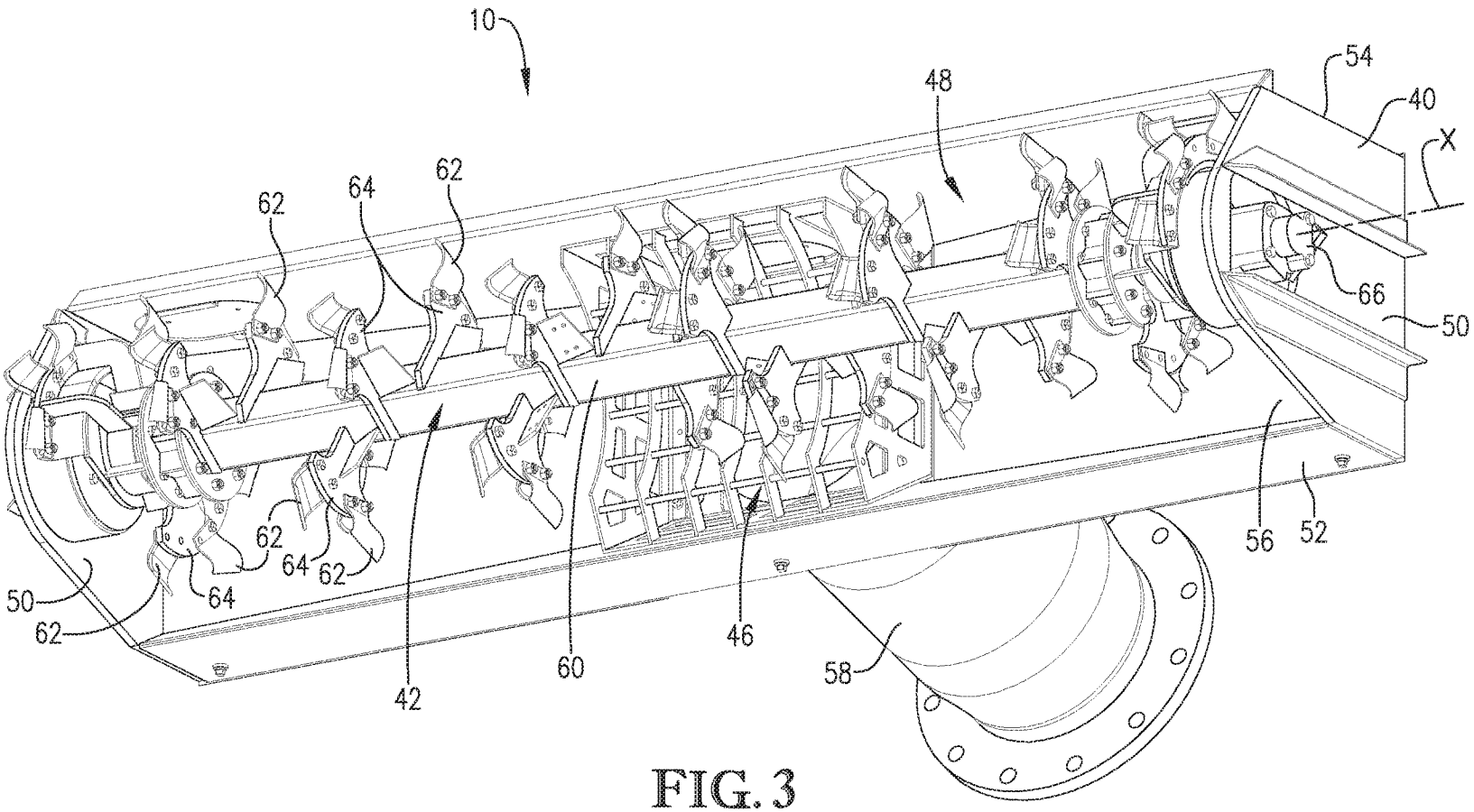
Figure 4:
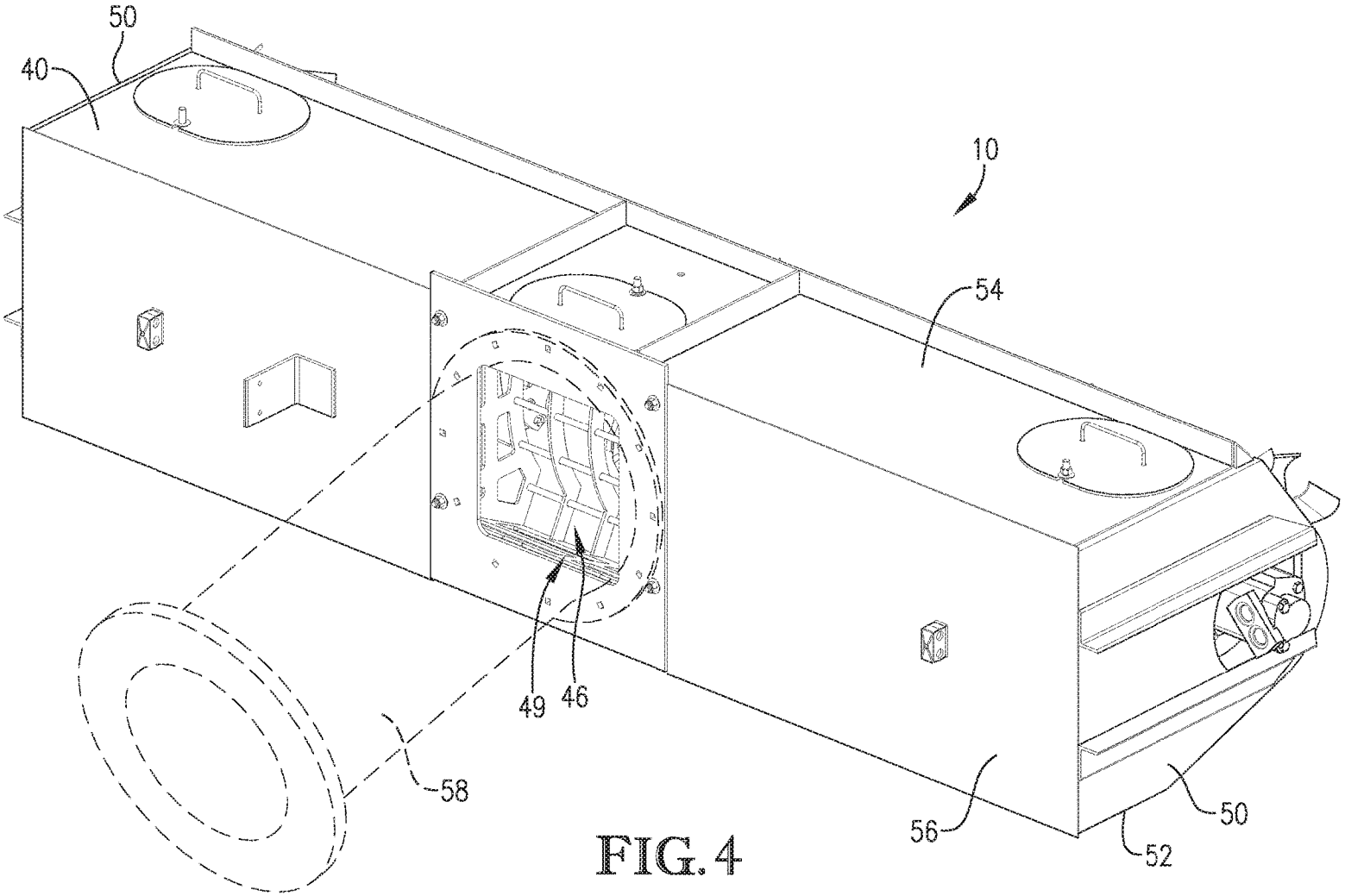
Figure 5:
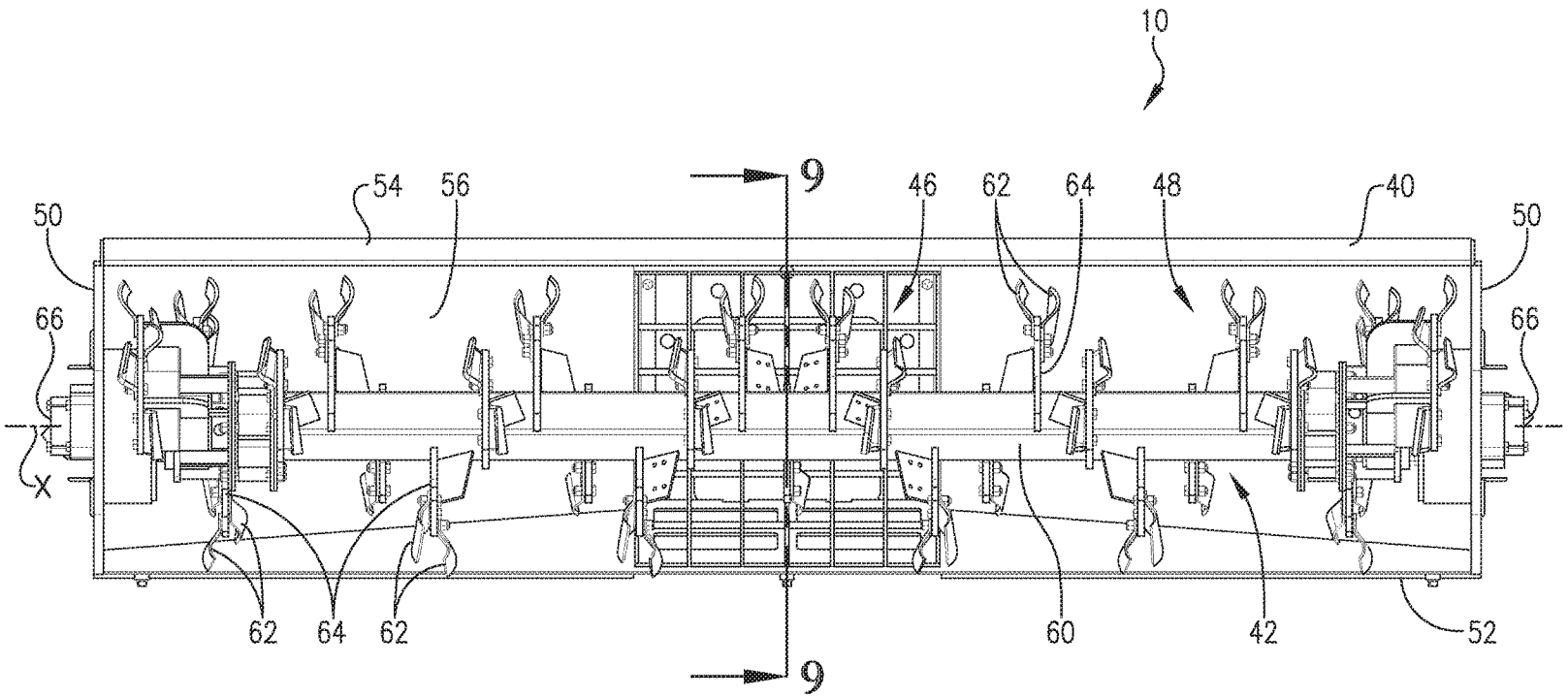
Figure 6:
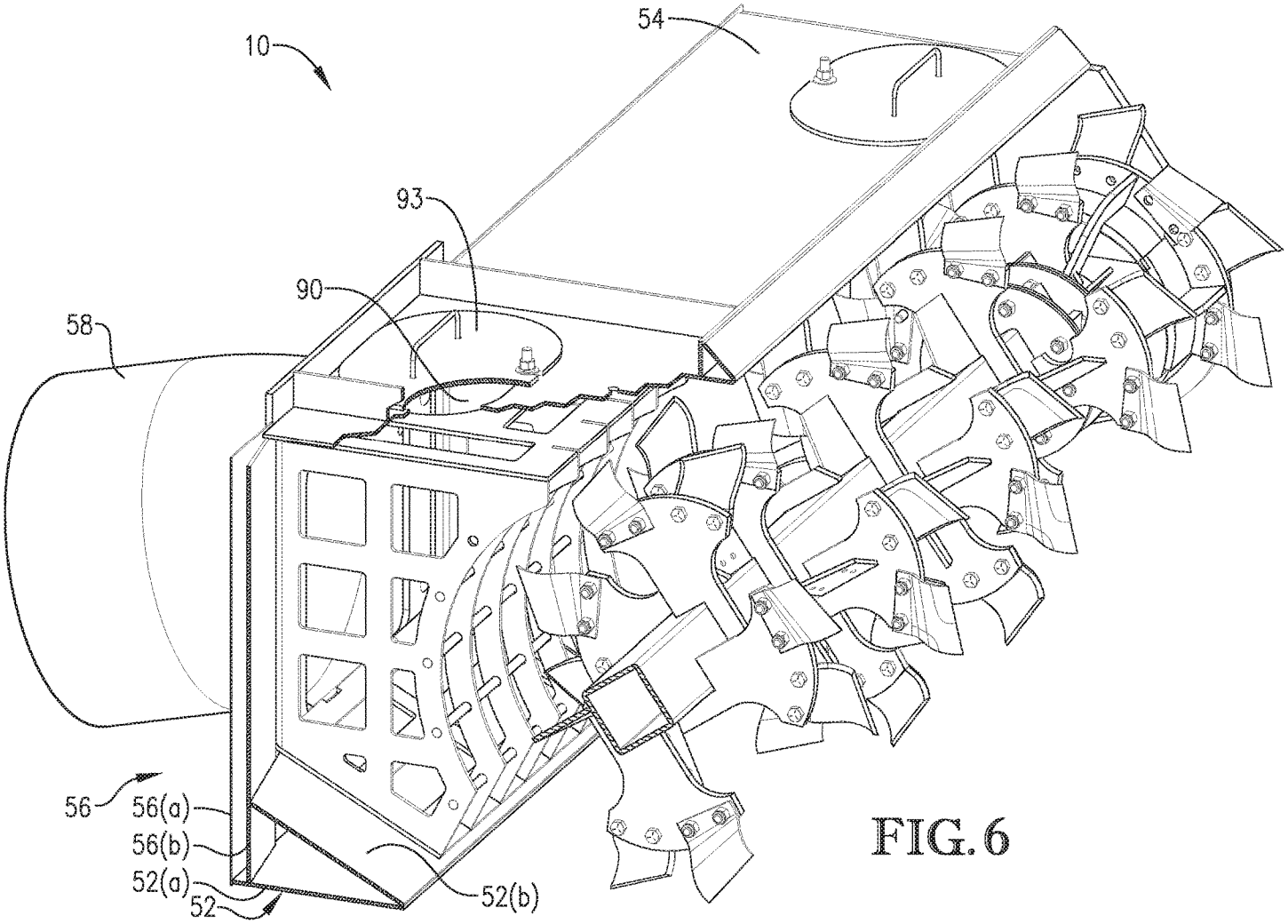
Figure 8:
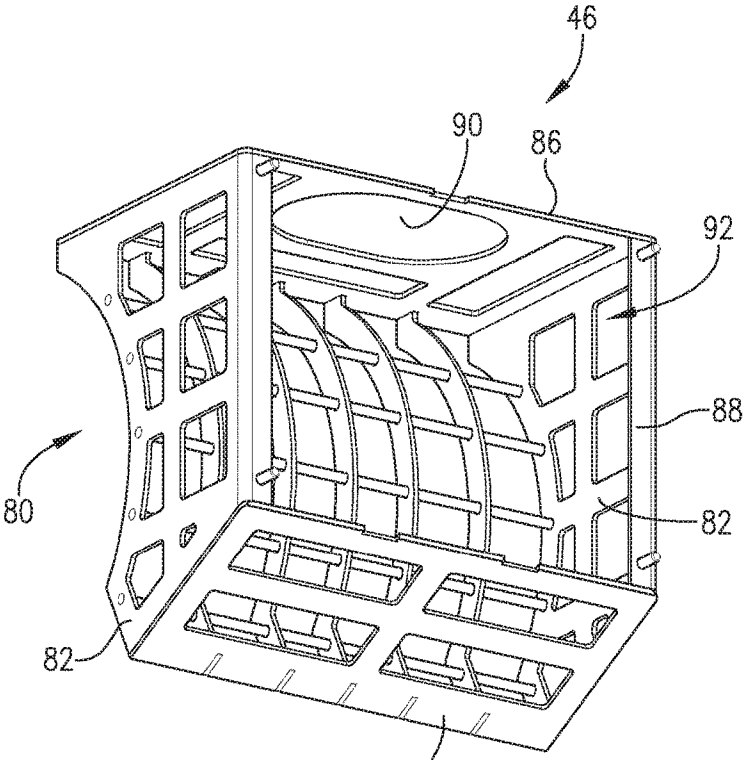
Figure 7:
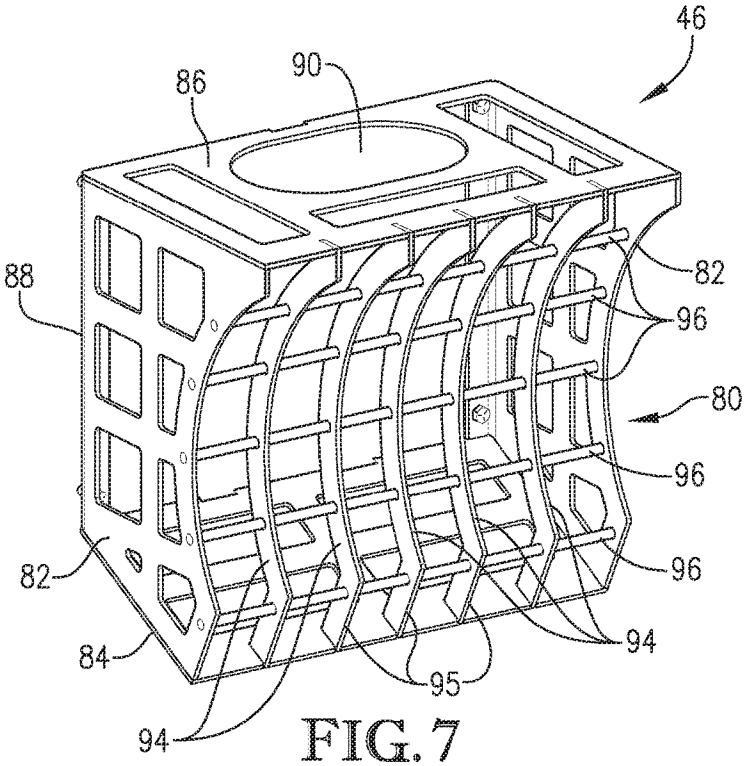

FIG. 3 a front, left perspective view of the cutterhead from the watercraft of FIGS. 1-2, particularly illustrating a shroud, a cutterbar, and a debris guard of the cutterhead;

FIG. 4 is a back, right perspective view of the cutterhead from FIG. 3, with a conduit on a back portion of the shroud shown in phantom to illustrate a port on the shroud;

FIG. 5 is a front elevation view of the cutterhead from FIGS. 4-5;

FIG. 6 is a right partial perspective view of the cutterhead from FIGS. 3-5, with a portion of the shroud and cutterbar cut away to show the debris guard secured within an interior space of the shroud;

FIG. 7 is a front perspective view of the debris guard according to embodiments of the present invention;

FIG. 8 is a rear perspective view of the debris guard from FIG. 7; and

Figure 9:
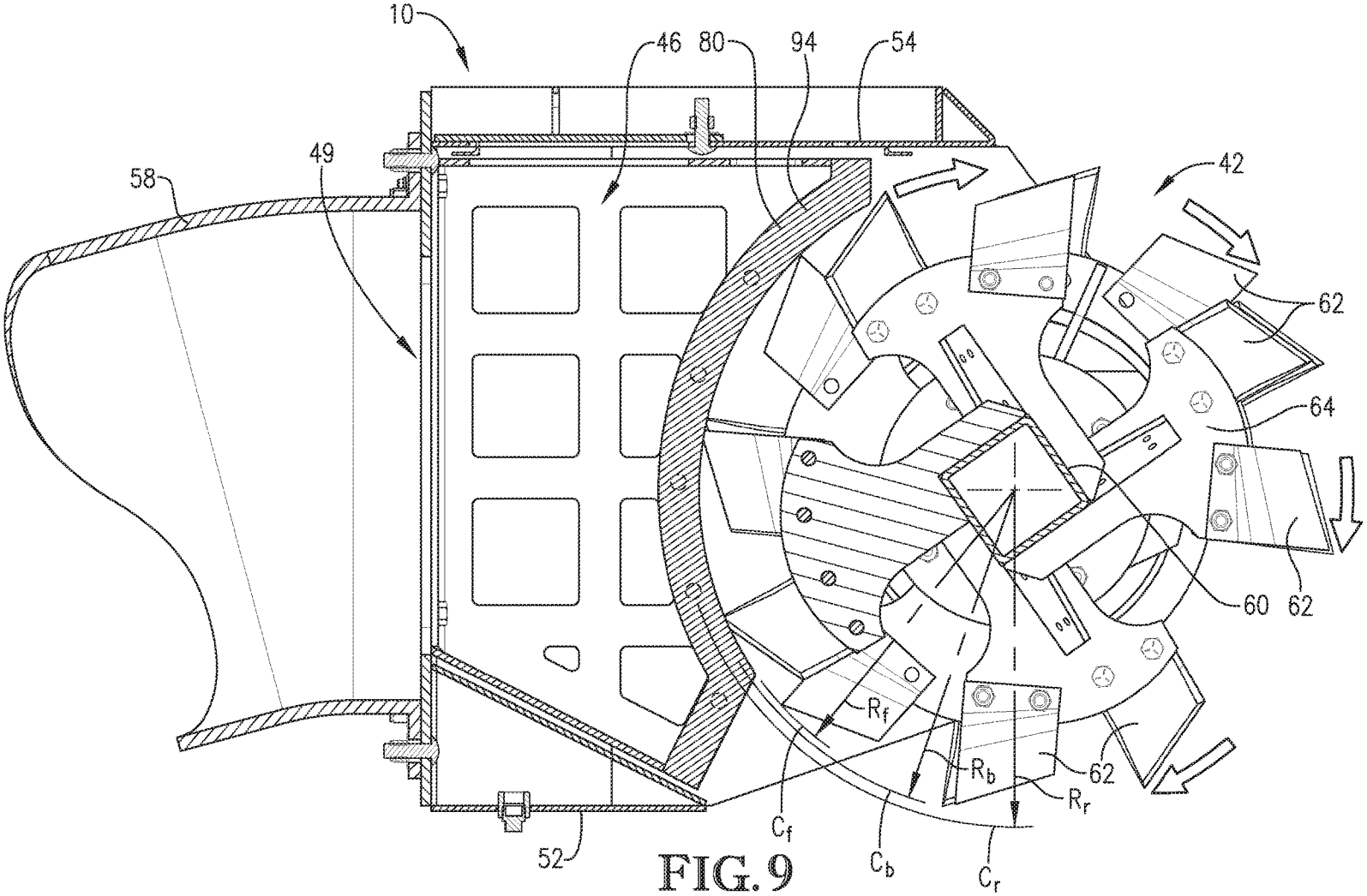

FIG. 9 is a cross section view of the cutterhead of embodiments of the present invention, taken along the line 9-9 from FIG. 5.

The drawing figures do not limit the present invention to the specific embodiments disclosed and described herein. The drawings are not necessarily to scale, emphasis instead being placed upon clearly illustrating the principles of the technology.

DETAILED DESCRIPTION

The following detailed description of various embodiments of the present technology references the accompanying drawings which illustrate specific embodiments in which the technology can be practiced. The embodiments are intended to describe aspects of the technology in sufficient detail to enable those skilled in the art to practice them. Other embodiments can be utilized and changes can be made without departing from the scope of the technology. The following detailed description is, therefore, not to be taken in a limiting sense. The scope of the present technology is defined only by the appended claims, along with the full scope of equivalents to which such claims are entitled.

Note that in this description, references to "one embodiment" or "an embodiment" mean that the feature being referred to is included in at least one embodiment of the present invention. Further, separate references to "one embodiment" or "an embodiment" in this description do not necessarily refer to the same embodiment; however, such embodiments are also not mutually exclusive unless so stated, and except as will be readily apparent to those skilled in the art from the description. For example, a feature, structure, act, etc. described in one embodiment may also be included in other embodiments. Thus, the present invention can include a variety of combinations and/or integrations of the embodiments described herein.

Referring now to the drawings, and particularly FIGS. 1-2, embodiments of the present invention may include a cutterhead 10 provided as a part of a watercraft 12 or added to an existing watercraft 12. The watercraft 12 may be any conventional type of watercraft, and in some embodiments may be a dredge having a catamaran-type hull configuration with two buoyant pontoons 18 and 20, an engine compartment 22, a cab 24 where the operator may be located, and a boom 26 for moving the cutterhead 10, with the boom 26 being positioned between the pontoons 18 and 20. The watercraft 12 has certain of the same general components as the watercrafts shown in U.S. Pat. Nos. 5,481,856 and 5,782,660, the entire disclosures of which are incorporated herein by reference.

Remaining with FIGS. 1 and 2, the boom 26 may be pivotally mounted near a stern of the watercraft 12 and supported near the bow of the watercraft 12 by a hoist 28. As such, a forward end of the boom 26 may be raised and lowered, via lift cables connected to the hoist 28, to an effective height relative to the surface of the water on which the watercraft 12 is supported. As such, because the cutterhead 10 is connected to the boom's 26 forward end, the boom 26 is operable to raise and lower the cutterhead 10 relative to the surface of the water. Generally, the watercraft 12 may be operated in shallow bodies of water, such that the cutterhead 10 can be lowered to a position adjacent to the water-bed of the body of water, as is illustrated in FIG. 2.

The watercraft 12 may be provided with its own propulsion system such as an inboard engine and forced water-jet drive or a screw stern drive, or one or more outboard engines. Alternatively, the watercraft 12 may comprise a watercraft propulsion system as shown in the aforementioned U.S. Pat. No. 5,782,660. For example, as illustrated in FIGS. 1 and 2, the watercraft 12 may have a paddlewheel-type propulsion system comprising one or more paddlewheels 30. As such, a rotation of the paddlewheels 30 can provide propulsion for the watercraft 12. The paddlewheels 30 may be hydraulically powered, such as by a hydraulic pump that is itself powered by a diesel engine housed in the engine compartment 22. In some embodiments, the diesel engine may comprise a 445 horsepower diesel engine. The propulsion system may also include its own boom and hoist, such that the paddlewheels 30 can be raised and lowered, via lift cables, relative to the surface of the water. As such, the paddlewheels 30 can be used to propel the watercraft 12 as they are positioned on the surface of the water. Alternatively, the paddlewheels 30 can be lowered to a position adjacent to the water-bed, such that the paddlewheels 30 can propel the watercraft 12 by rotating about the surface of the water-bed. In some alternative embodiments, the watercraft 12 may be positioned by the use of a plurality of cables and winches, with the cables anchored to the shore, pilings or the like, whereby the position of the watercraft 12 on the water may be changed by lengthening and shortening the cables.

Turning to the cutterhead 10 in more detail, and with particular reference to FIGS. 3-5, the cutterhead 10 of embodiments of the present invention broadly includes a shroud 40, a rotatable cutterbar 42 (not shown in FIG. 5), a cutter pump 44 (See FIGS. 1 and 2), and a debris guard 46. The shroud 40 may be made of corrosion-resistant material such as stainless steel or other material provided with a coating that resists corrosion in marine or otherwise harsh environments. The shroud 40 may be constructed in the form of a partial enclosure with a front margin 48 at its front end (See FIGS. 3 and 5) and a port 49 at its rear end (See FIG. 4). As described below, an interior of the cutterhead 10 may be formed in a generally funnel-shape, so as to act as a funnel for collecting and delivering fluidized water-bed material (e.g., a slurry) through the shroud 40 and to the cutter pump 44. In more detail, the shroud 40 may broadly comprise pair of side sections 50, a bottom section 52, a top section 54, and a back section 56, with the back section 56 including the port 49 that is fluidly connected to the cutter pump 44 (See FIGS. 1 and 2) via a conduit 58 (See FIGS. 1-4). The sections of the shroud 40 may comprise individual pieces of material secured together via various methods of attachment, such as by weld, fasteners (e.g., nut and bolt combinations, rivets, etc.), or the like.

The side sections 50 may extend between the bottom section 52 and the top section 54. As such, that front edges of the side sections 50, the front edge of the bottom section 52, and the front edge of top section 54 together form the front margin 48, which presents a large opening to collect fluidized water-bed material. The funnel-shaped interior of the shroud is configured to, thereafter, deliver the material to the cutter pump 44 through the debris guard 46, the port 49, and conduit 58. With respect to the cutterhead 10, the term "front" or "forward," as used herein, means a direction towards to cutterbar 42, while the term "back," "rear," or "rearward" means a direction towards the back section 56 of the shroud 40.

In some embodiments, one or more of the sections (e.g., side sections 50, bottom section 52, top section 54, and/or back section 56) of the shroud 40 may comprise an inner wall and an outer wall. In such embodiments, the outer walls may be oriented generally horizontally or vertically, so as to provide the shroud 40 its outer rectangular shape. However, one or more of the sections' inner walls may be oriented at an angle, with respect to the outer walls, so as to present the funnel shape of the interior of the shroud 40. The inner and outer walls may be secured together via various methods of attachment, such as by welds. Such a funnel shape may be beneficial so as to direct fluidized water-bed material (e.g., water, water-bed material, or slurry) and/or other debris inward from the front margin 48 to the guard 46 and the port 49 at the back section 56 of the shroud.

In more detail, as illustrated by FIG. 6, the bottom section 52 of the shroud 40 may comprise an outer wall 52(*a*) and an inner wall 52(*b*). The outer wall 52(*a*) may be oriented generally horizontally so as to form part of the rectangular exterior of the shroud 40. The inner wall 52(*b*) may be oriented at an angle with respect to the outer wall 52(*a*). The inner wall 52(*b*) may extend upward from the front edge of the bottom section 52 in a direction towards a mid-portion of the back section 56 (e.g., towards the port 49). As such, the inner wall 52(*b*) forms part of the interior funnel shape of the shroud 40, so as to direct fluidized water-bed material (or other liquid and debris) inward from the front margin 48 to the port 49. Similarly, as illustrated by FIG. 6, the back section 56 of the shroud 40 may comprise an outer wall 56(*a*) and one or more inner walls 56(*b*). The outer wall 56(*a*) may be oriented generally vertically so as to form part of the rectangular exterior of the shroud 40. The back section 56 may also include an inner wall 56(*b*), which may be oriented at an angle with respect to the outer wall 56(*a*). For instance, the inner wall 56(*b*) may extend outward from the port 49 towards a mid-portion of one of the side sections 50. As such, the inner wall 52(*b*) forms part of the interior funnel shape of the shroud 40, so as to direct fluidized water-bed material (or other liquid and debris) inward from the front margin 48 to the port 49. The back section 56 may also include a second, similar inner wall on the opposite side of the port 49, extending from the port 49 to the other side section 50. It should be understood that the other sections of the shroud 40 may be similarly formed with inner walls and outer walls, so as to form the funnel shape of the interior of the shroud 40.

Returning to FIGS. 3 and 5, the cutterbar 42 is illustrated being rotatably secured within the shroud 40. The cutterbar 42 may comprise a longitudinal support shaft 60 extending along a rotational axis X of the cutterbar 42. The cutterbar 42 may also include a plurality of blades 62 extending generally radially from the shaft 60. In some embodiments the cutterbar 42 may comprise a plurality of blade brackets 64 that extend radially from the shaft 60, with each of the blade brackets 64 supporting one or more blades 62. The cutterbar 42, and thus the blades 62, may be caused to rotate by one or more motors 66, which may be electrically or hydraulically actuated. As discussed in more detail below, the rotation of the cutterbar 42 allows the blades 62 to grind into the water-bed and to churn water-bed material, such that the water-bed material can be fluidized with the surrounding liquid to form a slurry.

As shown in FIGS. 1 and 2, the cutter pump 44 is positioned behind the shroud 40, such that an inlet of the cutter pump 44 is fluidly connected with the port 49 via the conduit 58 (See also FIGS. 3 and 4). The cutter pump 44 may be a centrifugal pump, and most preferably may be a solid waste or a chopper pump. The cutter pump 44 may be driven by an electric motor, hydraulic motor, power take-off, or the like. By way of example, the cutter pump 44 may be a chopper pump, such as sold by Vaughan Co., Inc. of Montesano, Wash., USA and as shown and described in U.S. Pat. Nos. 3,973,866, 4,840,384, 4,842,479, 5,076,757, 5,456,580, 5,460,482, 5,460,483, 7,125,221, 7,841,550 and 8,105,017, the entire disclosures of which are incorporated herein by reference. With reference to FIGS. 1 and 2, a discharge pipe 70 may be fluidly connected at a first end 71 to an outlet side of the cutter pump 44 and extend up along the boom 26 to a second end 72 positioned aft of the pontoons 18, 20 of the watercraft 12. The discharge pipe 70 may have a diameter of about eight inches or more. The discharge pipe 70 is configured to direct fluidized water-bed material to an additional conduit (not shown), which can discharge the fluidized water-bed material away from the watercraft 12, such as to an associated barge or to a shoreline.

Turning now to the debris guard 46 in more detail, and with reference to FIGS. 7 and 8, the debris guard 46 may be configured as a six-sided grate-like structure, with a front section 80, a pair of lateral side elements 82, a bottom element 84, a top element 86, and a back element 88. The components of the debris guard 46 may be formed from various materials having sufficient strength and durability to be used during dredging operations, such as stainless steel or some other material provided with a coating that resists corrosion in marine or otherwise harsh environments. The components of the debris guard 46 may be secured together by high-strength weld or the like; however, other methods of securement may be used. In addition, one or more of the components of the debris guard 46 may be integrally formed.

The lateral side elements 82 may extend from the bottom element 84 to the top element 86 and from the front section 80 to the back element 88. As such, the lateral side elements 82 may be oriented generally vertically when in use (e.g., as shown in FIGS. 6 and 9). As illustrated in FIGS. 7 and 8, the side elements may, in some embodiments, include a plurality of openings formed therethrough. Such openings may allow liquid to pass therethrough when the debris guard 46 is in use in the cutterhead 10 during dredging operations (e.g., as shown in FIGS. 6 and 9).

The bottom element 84 may extend from the front section 80 to the back element 88 and between the side elements 82. As will be described in more detail below, the bottom element 84 may be secured to and/or engaged with the bottom section 52 of the shroud 40, within the interior of the shroud 40. As such, the bottom element 84 may be oriented at an angle, with such angle corresponding to the angle at which the inner wall 52(*a*) is oriented. The top element 86 may extend from the front section 80 to the back element 88 and between the lateral side elements 82. As will be described in more detail below, the top element 86 may be secured to and/or engaged with the top section 54 of the shroud 40. As such, the top element 86 may be oriented generally horizontally. In some embodiments, the top element 86 may include a large aperture 90. When the debris guard 46 is positioned and/or secured within the interior of the shroud 40, as illustrated in FIG. 6, the aperture 90 may be aligned with an access door 93 on the top section 54 of the shroud 40, such that a user can access an interior of the debris guard 46 from outside of the shroud 40, such as for cleaning, clog removal, maintenance, and the like.

The back element 88 of the debris guard 46 may extend between the side elements 82 and from the bottom element 84 to the top element 86. In some embodiments, the back element 88 may be in the form of a frame that surrounds a large opening 92. In other embodiments, the back element 88 may not have a physical structure, such that the large opening 92 of the back element 88 is simply presented by the space between the back edges of each of the side elements 82, the bottom element 84, and the top element 86.

The debris guard 46 is configured to be inserted and secured within the interior (or interior space) of the shroud 40, such that the large opening 92 is generally aligned with or positioned over the port 49 (i.e., the frame of the back element 88 surrounds the port 49) on the back section 56 of the shroud 40. As such, the debris guard 46 may be positioned within the interior space of the shroud 40 between the cutterbar 42 and the port 49, as shown in FIG. 9, such that fluidized water-bed material flowing through the debris guard 46 (from the front section 80 and/or the side sections 82) can exit the debris guard 46 through the back element 88, through the port 49, and to the pump 44 (not shown in FIG. 9). The debris guard 46 may be secured to the shroud 40 by various methods of securement, such as by welding, fasteners (e.g., nut & bolt combinations, rivets, etc.), or the like. Specifically, the back element 88 of the debris guard 46 may be secured to the back section 56 of the shroud 40, the top element 86 of the debris guard 46 may be secured to top section 54 of the shroud 40, and the bottom element 84 of the debris guard may be secured to the bottom section 52 of the shroud 40.

Returning to FIGS. 7 and 8, the front section 80 of the debris guard 46 may extend between the side elements 82 and from the bottom element 84 to the top element 86. The front section 80 may comprise a plurality of generally vertically-extending spacing elements, which may, in some embodiments, be in the form of fin elements 94, such as illustrated in the drawings. The fin elements 94 may be thin, arcuately-shaped elements that extend from the bottom element 84 to the top element 86. The fin elements 94 may be secured to each of the bottom element 84 and the top element 86 via weld. In some embodiments, the bottom element 84 and the top element 86 may include notches that receive ends of the fin element 94, so as to provide further structural integrity to the front section 80. In some embodiments, each of the fin elements 94 may include a bottom extension piece 95 that extends from the bottom element 84 to the main, arcuately-shaped portion of the fin element 94. Such bottom extension pieces 95 may be generally linear in shape and may be used to ensure that the main, arcuately-shaped portion of the fin elements 94 are properly aligned with the cutterbar 42, as will be discussed in more detail below. It should be noted that, in some alternative embodiments, such extension pieces 95 may extend from the top element 86 to the main, arcuately-shaped portions of the fin elements 94.

In addition to the fin elements 94, the front section 80 may comprise a plurality of generally horizontally-extending spacing elements, which may, in some embodiments, be formed as rod elements 96, such as illustrated in the drawings. The rod elements 96 may extend generally horizontally between the side elements 82. In some embodiments, the rod elements 96 may extend through the fin elements 94 via holes formed in the fin elements 94. The rod elements 96 may be secured to each of side elements 82 via weld. In some embodiments, the side elements 82 may include holes that receive ends of the rod element 96, so as to provide further structural integrity to the front section 80. In some embodiments, the rod elements 96 may also be welded to the fin elements 94. As such, given the interconnected arrangement of fin elements 94 and rod elements 96, the front section 80 is configured to operate as a guard that allows liquid to flow between the spaces presented by the interconnected fin elements 94 and rod elements 96, while simultaneously filtering such flowing liquid by preventing large, solid debris from passing thereby. As such, and as will be described in more detail below, during operation of the cutterhead 10, large, solid pieces of debris that may enter the cutterhead 10 during dredging operations will be prevented from passing beyond the debris guard 46, such that the debris guard 46 prevents unwanted debris from being introduced into the pump 44.

In addition to preventing debris from entering the pump 44, the debris guard 46 is configured to facilitate removal of debris from the cutterhead 10. Specifically the arcuate shape of the front section 80 allows debris that is introduced to the cutterhead 10 by way of actuation of the cutterbar 42 (and/or force of the pump 44) to also be removed from the cutterhead 10 by the actuation of the cutterbar 42. As will be described in more detail below, the arcuate shape of the debris guard 46 allows the blades 62 of the cutterbar 42 to sweep across and/or through the front section 80, so as to force any debris away from and/or out of the debris guard 46. As such, the cutterhead 10 may be referred to as self-cleaning.

During dredging operations, the cutterhead 10 may be lowered to a position adjacent to the water-bed of a body of water (as shown in FIG. 2). In such a position, the cutterbar 42 of the cutterhead 10 can rotate, such that the blades 62 grind into the water-bed material. As such, the cutterhead 10 can fluidized the water-bed material into the surrounding liquid of the body of water, thereby forming a slurry mixture of water and water-bed material. Simultaneously, the cutter pump 44 is operable to draw the slurry mixture into the shroud 40, through the cutter pump 44, through the discharge pipe 70, and out the second end 72 of the discharge pipe 70. To remove the water-bed material from the body of water and the watercraft 12, a relatively large diameter hose or conduit (not shown) may be attached to the second end 72 of the discharge pipe 70 so as to direct such fluidized water-bed material from the watercraft to an adjacent barge or to a shoreline.

During such dredging operations, the cutterhead 10 may encounter large, solid objects (i.e., debris) that can clog or damage the cutterhead 10 and/or the pump 44. As such, some previously-used cutterheads incorporate grate-like guards positioned over the ports on the back portion of the cutterhead, so as to prevent large, solid objects from passing through to the pump. Such previously-used guards were generally formed in a planar manner, such as in the form of a flat piece of grating. Although such planar guards were sufficient for preventing large debris from passing through to the pump, the planar guards allowed such debris to remain stuck within the shroud of the cutterhead. For example, as large debris is forced past the cutterbar (under the force of the cutterbar and the pump), the large debris can become stuck behind the cutterbar in the corners of the shroud (e.g., where the top section and/or the bottom section joins to meet the back section) or in the guard itself. Contrastingly, the debris guard 46 of the present invention, in addition to blocking unwanted debris from passing into the pump 44, facilitates the removal of such unwanted debris from within the shroud 40 of the cutterhead 10 because of its arcuately-shaped front section 80.

In more detail, and with reference to FIG. 9, during dredging operations, the cutterbar 42 of the cutterhead 10 may be caused to rotate (e.g., in a clockwise direction as indicated by the arrows of FIG. 9). During such rotation, the cutterbar 42 blades 62 grind into the water-bed material and fluidize the water-bed material into the surrounding liquid of the body of water, thereby forming a slurry mixture of water and water-bed material. Such fluidized water-bed material is, thus, forced rearward, under the force of the cutterbar 42 and the pump 44, through the debris guard 46. It is noted that the funnel-shaped interior of the shroud 40 facilitates funneling of the fluidized water-bed material towards the debris guard 46. Any large, solid pieces of debris that may be forced rearward by the cutterbar 42 will enter the shroud 40 from near the bottom section 52 and will be forced to move in a clockwise manner by the rotation of the cutterbar 42. Instead of being caught up in the shroud 40 or within the debris guard 46, the blades 62 of the cutterbar 42 can sweep the unwanted debris across the front section 80 of the debris guard 46 and out of the interior of the shroud 40 near the top section 54 of the shroud 40. To accomplish such sweeping across the front section 80 of the debris guard 46, the front section 80 of the debris guard 46 is formed to include a generally arcuate shape that corresponds with the arcuate path made by the tips of the blades 62 of the cutterbar 42. As such, the tips of the blades 62 can be caused to rotate about generally the entire arcuately-shaped surface portion of the front section 80 of the debris guard 46, such that any large, solid pieces of debris that are filtered via the debris guard 46 can be swept away from the debris guard 46 and out of the shroud 40 by the cutterbar 42.

The arcuate shape of the front section 80 of the debris guard 46 will now be described in more detail. Beginning with the cutterbar 42, when rotating, the tips of each of the blades 62 trace a generally circular path about the rotational axis X of the cutterbar 42. The radius of such circles may vary, depending on the particular blade 62 and its distance from the rotational axis X. For instance, as illustrated in FIG. 9, certain blades 62 extend radially from the rotational axis X a greater amount than others. Nevertheless, the blade 62 that extends the furthest in a radial direction from the rotational axis X of the cutterbar 42 follows a generally circular path identified in FIG. 9 as Cb. The radius of the circular path Cb, which extends from the rotational axis X of the cutterbar 42, is identified in FIG. 9 as Rb. It is understood that the radius of curvature of the circular path Cb made by the corresponding blade 62 tip is also Rb. In some embodiments the radius of curvature Rb may have a value of between 11 and 13 inches, between 11.50 and 12 inches, or between 11.75 and 11.90 inches. In some specific embodiments, the radius of curvature Rb may have a value of 11.82 inches.

As noted above, the front section 80 of the debris guard 46 may be arcuately formed to correspond with the radius of curvature of the path Cb of the blade 62 tips. For example, as illustrated in FIG. 9, each of the fin elements 94 may be arcuately formed such that the front section 80 presents a generally concave shape. In certain embodiments, front edges of the side elements 82 may also be arcuately formed (as shown in FIGS. 7 and 8) so as to match the concave shape of the front section 80. Given the concave shape of the front section 80, the blades 62 of the cutterbar 42 can sweep along the arcuately-formed, forward-facing surface of the front section 80 of the debris guard 46 as the blades 62 rotate about their circular path (e.g., path Cb). In more detail, a front edge of each of the fin elements 94 (collectively the forward-facing surface of the front section 80) may extend along a generally circular curve Cf, as illustrated in FIG. 9. The curve Cf of the forward-facing surface of the front section 80 may have a center of curvature that coincides with the rotational axis X of the cutterbar 42. To ensure that the center of curvature of the curve Cf coincides with the rotational axis X, appropriately-sized extension sections 95 may be used to raise or lower the arcuately-shaped portion of the front section 80. However, it should be understood that in some embodiments the center of curvature of the curve Cf may not exactly coincide with the rotational axis X, but may, instead, be at least minimally spaced from the rotational axis X. For instance, in some embodiments, the center of curvature of the curve Cf may be set apart from the rotational axis X but may, nonetheless, be positioned within the support shaft 60. In view of the above, the curve Cf of the forward-facing surface of the front section 80 may include a radius of curvature Rf, as illustrated in FIG. 9. As will be described in more detail below, the radius of curvature Rf, may, in some embodiments, correspond to or be similar to the radius of curvature Rb of the path Cb of the blade 62 tips. In some embodiments the radius of curvature Rf may have a value of between 11 and 13 inches, between 11.25 and 12 inches, or between 11.50 and 11.75 inches. In some specific embodiments, the radius of curvature Rb may have a value of 11.57 inches.

In addition, as illustrated in FIG. 9, one or more of the rod elements 96 may extend through the arcuately-curved portion of the front section 80. Such rod elements 96 may be positioned rearward from the front edges of the fin elements 94 (and, thus, the forward-facing surface of the front section 80). Specifically the rod elements 96 may be positioned about 0.1 inches, about 0.25 inches, about 0.50 inches, about 1 inch, or about 2 inches rearward from the front edges of the fin element 94. In some specific embodiments, the rod elements 96 may be positioned 0.46 inches rearward from the front edges of the fin element 94. As such, the rod elements 96 that extend through the arcuately-curved portion of the fin elements 94 of the front section 80 may be positioned along a generally circular curve Cr, as illustrated in FIG. 9. The curve Cr may have a center of curvature that coincides with the rotational axis X of the cutterbar 42. However, it should be understood that in some embodiments the center of curvature of the curve Cr may not exactly coincide with the rotational axis X, but may, instead, be at least minimally spaced from the rotational axis X. For instance, in some embodiments, the center of curvature of the curve Cr may be set apart from the rotational axis X but may, nonetheless, be positioned within the support shaft 60. In view of the above, as illustrated in FIG. 9, the curve Cr of the rod elements 96 may comprise a radius of curvature Rr. As with the radius of curvature Rf of the fin elements 94 and/or the front section 80, the radius of curvature Rr of the rod elements 96, may, in some embodiments, correspond to or be similar to the radius of curvature Rb of the path Cb of the blade 62 tips. In some embodiments the radius of curvature Rr may have a value of between 11 and 13 inches, between 11.50 and 12.5 inches, or between 12 and 12.40 inches. In some specific embodiments, the radius of curvature Rr may have a value of 12.25 inches.

Given the above-described concave shape of the front section 80 of the debris guard 46, the blades 62 of the cutterbar 42 are permitted to rotate across the forward-facing surface (or face) of the front section 80, so as to sweep any unwanted debris away from the front section 80 and out of the shroud 40 of the cutterhead 10. In some embodiments, the blade 62 tips will rotate in a path Cb that has a radius of curvature Rb that is equal to, nominally less than, and/or less than the radius of curvature Rf of the curve Cf presented by the front edges of the fin elements 94. In such embodiments, the blade 62 tips will be configured to sweep across the forward-facing surface of the font section 80 at a position just forward of the front section 80. Actuation of the blades 62 is generally sufficient to sweep any unwanted debris away from the front section 80 and out of the shroud 40 of the cutterhead 10. It is understood that because the path Cb of the blade 62 tips and the curve Cf of the front section 80 of the debris guard are both generally arcuate with the common center of curvature (i.e., rotational axis X of the cutterbar 42), the separation distance between the blade 62 tips and the front section 80 remains generally constant as the blades 62 pass across the arcuately-curved portion of the front section 80. Such consistency facilitates the ability of the blades 62 to efficiently sweep unwanted debris away from the debris guard 46 and out of the shroud 40.

In other embodiments, the blade 62 tips may rotate in a path Cb that has a radius of curvature Rb that is larger than the radius of curvature Rf of the curve Cf presented by the front edges of the fin elements 94. In such embodiments, the tips of the blades 62 will extend rearward past the front edges of the fin elements 94 (and, thus, the forward-facing surface of the front section 80). To accomplish such, the blades 62 may be spaced apart along the longitudinal support shaft 60 of the cutterbar 42 in a manner that positions the blades 62 between the adjacent, spaced-apart fin elements 94. In addition, the tips of the blades 62 should not extend rearward enough that they would engage with the rod elements 96. To accomplish such, the radius of curvature Rb of the path Cb of the blade 62 tips should be less than the radius of curvature Rr presented by the curve Cr presented by the position of the rod elements 96. Thus, in some embodiments, the radius of curvature Rb of the of the path Cb of the blade 62 tips may have a value that is between the the radius of curvature Rf presented by the curve Cf of the front edges of the fin elements 94 and the radius of curvature Rr of the curve Cr presented by the rod elements 96. Such a positioning of the blades 62 allows for efficient removal of unwanted debris from the shroud 40. Specifically, with the blade 62 tips permitted to extend through at least a portion of the front section 80 of the debride guard 46, past the front edges of the fin elements 94, the blades 62 can dislodge any unwanted debris that may be stuck within the debris guard 46. Thereafter, the rotation of the blades 62 functions to sweep such unwanted debris out of the shroud 40.

In view of the above, and to summarize dredging operations using the cutterhead 10 of embodiments of the present invention, the cutterhead 10 may be lowered to a position adjacent to the water-bed of a body of water (as shown in FIG. 2). In such a position, the cutterbar 42 of the cutterhead 10 can be caused to rotate, such that the blades 62 grind into the water-bed material so as to fluidize the water-bed material into the surrounding liquid of the body of water, thereby forming a slurry mixture of water and water-bed material. Simultaneously, the cutter pump 44 operates to draw the slurry mixture into the shroud 40, with such drawing in facilitated by the funnel-shaped interior of the shroud 40. The slurry is pumped through the cutter pump 44, through the discharge pipe 70, and out the second end 72 of the discharge pipe 70 away from the watercraft 12. During such dredging, any large, solid objects, such as rocks, trash, or other debris which may be encountered, are prevented from entering the cutter pump by the debris guard 46, which permits liquid to pass therebetween but prevents large, solid objects from passing therebetween. In addition, the concave shape of the front section 80 of the debris guard allows the blades 62 to pass along the front surface of the front section 80, so as to sweep any debris away from the debris guard 46 and out of the cutterhead 10.

Although the invention has been described with reference to the preferred embodiment illustrated in the attached drawing figures, it is noted that equivalents may be employed and substitutions made herein without departing from the scope of the invention as recited in the claims.

What is claimed is:

1. A cutterhead for dredging water-bed material from a body of water, the cutterhead comprising:

a shroud presenting a front margin for receiving water-bed material into an interior space of said shroud, wherein said shroud includes a port from which water-bed material can be removed from the interior space of said shroud;

a rotatable cutterbar at least partially received within the interior space of said shroud; and a debris guard positioned between said cutterbar and said port, wherein said debris guard is operable to filter the water-bed material removed from said shroud through the port, wherein at least a portion of said debris guard that faces said cutterbar includes a concave shape, wherein said debris guard comprises a front section, a top section, a bottom section, a pair of side sections, and a back section, wherein said back section covers said port of said shroud, and wherein said front section is formed in the concave shape.

2. The cutterhead of claim 1, wherein said cutterbar includes a plurality of blades extending radially from a support shaft, wherein said support shaft defines an axis of rotation of said cutterbar.

3. The cutterhead of claim 2, wherein during rotation of said cutterbar, tips of said blades travel in an arcuate path defined by a radius of curvature Rb.

4. The cutterhead of claim 3, wherein the concave shape of the front section is defined by a radius of curvature Rf having a center of curvature positioned within the support shaft of said cutterbar, and wherein the radius of curvature Rb is greater than the radius of curvature Rf.

5. A cutterhead for dredging water-bed material from a body of water, the cutterhead comprising:

a shroud presenting a front margin for receiving water-bed material into an interior space of said shroud, wherein said shroud includes a port from which water-bed material can be removed from the interior space of said shroud;

a rotatable cutterbar at least partially received within the interior space of said shroud; and a debris guard positioned between said cutterbar and said port, wherein said debris guard is operable to filter the water-bed material removed from said shroud through the port, wherein at least a portion of said debris guard that faces said cutterbar includes a concave shape, wherein said cutterbar includes a plurality of blades extending radially from a support shaft, wherein said support shaft defines an axis of rotation of said cutterbar, wherein during rotation of said cutterbar, tips of said blades travel in an arcuate path defined by a radius of curvature Rb, wherein a front section of said debris guard is formed in the concave shape, wherein the concave shape is defined by a radius of curvature Rf having a center of curvature positioned within the support shaft of said cutterbar, wherein the radius of curvature Rb is greater than the radius of curvature Rf.

6. The cutterhead of claim 5, wherein said debris guard comprises the front section, a top section, a bottom section, a pair of side sections, and a back section, wherein said back section covers said port of said shroud.

7. A cutterhead for dredging water-bed material from a body of water, the cutterhead comprising:

a shroud presenting a front margin for receiving water-bed material into an interior space of said shroud, wherein said shroud includes a port from which water-bed material can be removed from the interior space of said shroud;

a rotatable cutterbar at least partially received within the interior space of said shroud; and a debris guard positioned between said cutterbar and said port, wherein said debris guard is operable to filter the water-bed material removed from said shroud through the port, wherein at least a portion of said debris guard that faces said cutterbar includes a concave shape, wherein said debris guard comprises a front section, with said front section being formed in the concave shape, wherein said front section comprises a plurality of spaced apart fin elements.

8. The cutterhead of claim 7, wherein said fin elements extend generally vertically, and wherein said front section further comprises a plurality of spaced apart spacing elements extending generally horizontally through said fin elements.

9. The cutterhead of claim 8, wherein said spacing elements are positioned about an arcuate path defined by a radius of curvature Rr having a center of curvature being positioned within a support shaft of said cutterbar.

10. The cutterhead of claim 9, wherein said cutterbar includes a plurality of blades extending radially from a support shaft, wherein during rotation of said cutterbar, tips of said blades travel in an arcuate path defined by a radius of curvature Rb, wherein the concave shape of the front section of said debris guard is defined by a radius of curvature Rf having a center of curvature being positioned within the support shaft of said cutterbar, wherein the radius of curvature Rb is greater than the radius of curvature Rf, and wherein the radius of curvature Rb is less than the radius of curvature Rr.

11. The cutterhead of claim 10, wherein said blades are spaced apart about said support shaft, such that at least one blade is positioned between adjacent fin elements.

12. A dredge-type watercraft comprising:

a hull;

a boom having first and second ends, with the first end being pivotably secured to the hull; and a cutterhead secured to the second end of said boom, with said cutterhead including— a rotatable cutterbar for fluidizing water-bed material;

a shroud for receiving the fluidized material, wherein said shroud includes a port through which the fluidized material is removed from said shroud; and a debris guard positioned over said port, wherein said debris guard is configured to filter debris from the fluidized material passing through said port, wherein at least a portion of said debris guard facing the cutterbar is formed in a concave shape, such that said cutterbar is configured to remove the filtered debris from said debris guard, wherein said cutterbar includes a plurality of blades extending radially from a support shaft, wherein during rotation of said cutterbar, the tips of said blades travel in an arcuate path defined by a radius of curvature Rb, wherein the concave shape of said debris guard is defined by a radius of curvature Rf having a center of curvature being positioned within a support shaft of said cutterbar, and wherein the radius of curvature Rb is greater than the radius of curvature Rf.

13. The watercraft of claim 12, further comprising a cutter pump including an inlet fluidly connected to the interior space of the shroud, wherein the cutter pump is configured to draw the fluidized material in through the shroud and into the cutter pump.

14. The watercraft of claim 13, wherein the cutter pump further includes an outlet fluidly connected to a discharge pipe, wherein the discharge pipe extends from the cutter pump, up along the boom, and to a position adjacent to the hull of the watercraft.

15. The watercraft of claim 12, wherein the watercraft further includes a hoist operable to raise and lower the boom, and wherein the hoist is configured to lower the boom such that the cutterhead is positioned adjacent to a water-bed of a body of water on which the watercraft is configured to operate.

16. A method for dredging material from a water-bed, the method comprising the following steps:

(a) lowering a boom from a watercraft, wherein the boom includes a cutterhead attached thereto with a cutterbar for fluidizing material from the water-bed, wherein the cutterhead includes a port through which the fluidized material is removed from the cutterhead, and wherein the cutterhead includes a debris guard positioned over the port for filtering debris from the fluidized material, wherein the debris guard includes a front section formed from a plurality of spaced apart fin elements, wherein the fin elements are formed in a concave shape, wherein during the lowering of step (a), the boom is lowered such that the cutterhead is positioned adjacent to the water-bed;

(b) fluidizing material from the water-bed;

(c) drawing fluidized material into the cutterhead;

(d) filtering, via the debris guard, debris from the fluidized material; and (e) removing the filtered debris, via the cutterbar, from the debris guard.

17. The method of claim 16, wherein said cutterbar includes a plurality of blades extending radially from a support shaft, wherein during rotation of said cutterbar, the tips of said blades travel in an arcuate path defined by a radius of curvature Rb, wherein the concave shape of said debris guard is defined by a radius of curvature Rf having a center of curvature being positioned within a support shaft of said cutterbar, and wherein the radius of curvature Rb is greater than the radius of curvature Rf.

18. The method of claim 17, wherein said blades are spaced apart about said cutterbar, such that at least one blade is positioned between each pair of adjacent fin elements.

* * * * *